US005720330A

United States Patent [19]

Schmalz, Jr.

[11] Patent Number: 5,720,330

[45] Date of Patent: Feb. 24, 1998

[54] SQUEEZE BULB FOR LIQUID EXTRACTION DEVICE

[76] Inventor: John W. Schmalz, Jr., 1727 SW. 18th St., Boynton Beach, Fla. 33426-6413

[21] Appl. No.: 786,962

[22] Filed: Jan. 23, 1997

[51] Int. Cl.[6] ..... B65B 1/04

[52] U.S. Cl. ..... 141/26; 141/114; 99/345; 222/206

[58] Field of Search ..... 141/114, 21–28, 141/310, 31; 99/345; 222/206, 209, 213, 215, 420; 220/366.1

[56] References Cited

U.S. PATENT DOCUMENTS 2,746,651 5/1956 Lewis ..... 222/213
5,638,872 6/1997 Porter ..... 141/26

FOREIGN PATENT DOCUMENTS 1095681 6/1955 France ..... 141/24

*Primary Examiner*—Henry J. Recla
*Assistant Examiner*—Steven O. Douglas
*Attorney, Agent, or Firm*—Robert M. Downey, PA

[57] ABSTRACT

A squeeze bulb for use on a liquid extraction device includes a collapsible wall structure formed of a flexible, resilient rubber; the wall structure being shaped and configured to include a main bulbous portion surrounding an interior chamber and an integral neck portion extending from the bulbous portion and terminating at an annular rim surrounding an open end. A passage extends through the neck portion, from the open end to the interior chamber, in fluid communication therebetween and is sized and configured for removable, snug-fitted receipt of a proximal end zone of an elongate tube of the liquid extraction device, in sealed relation therein. Stand-up supports provided at spaced intervals about the annular rim support the squeeze bulb in an upright position on a flat surface, when removed from the elongate tube, so that the annular rim is maintained in spaced relation above the flat surface to define ventilation gaps, permitting liquid to drain from the bulb interior and allowing air flow through the passage of the neck and to the interior chamber, thereby promoting drying of moisture within the squeeze bulb.

8 Claims, 1 Drawing Sheet

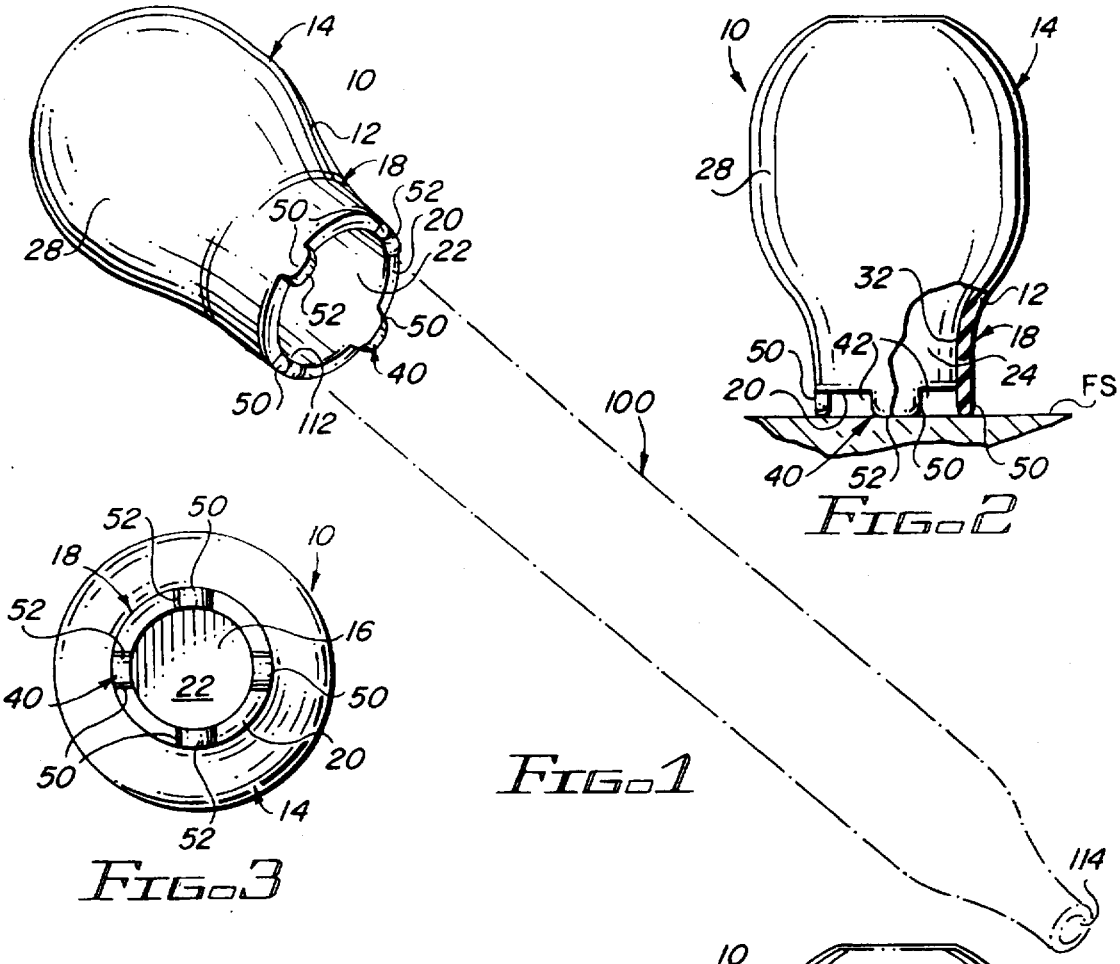
FIG. 1
FIG. 2
FIG. 3
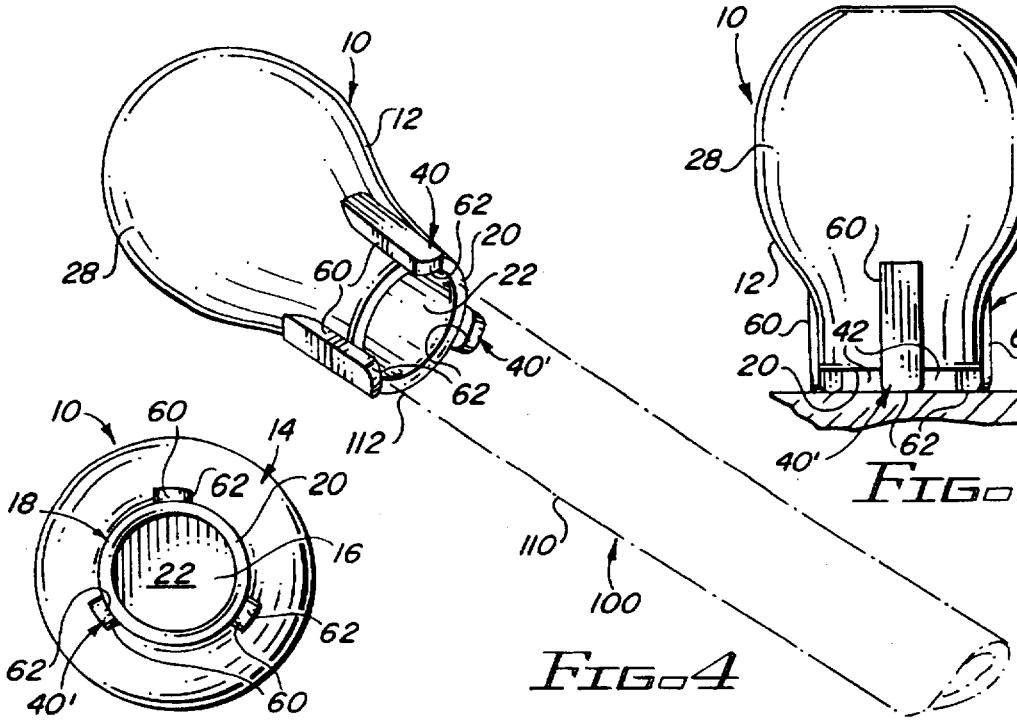
FIG. 4
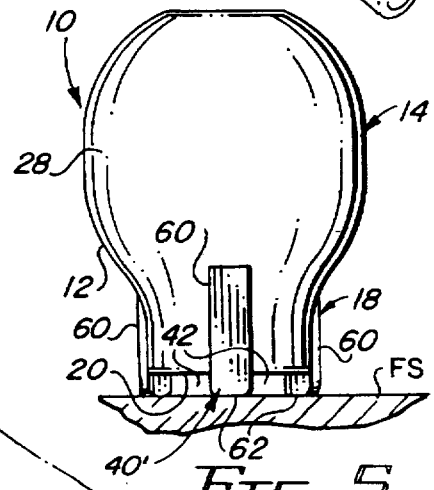
FIG. 5
FIG. 6

SQUEEZE BULB FOR LIQUID EXTRACTION DEVICE

BACKGROUND OF THE INVENTION

1. Field of the Invention

The present invention relates to improvements to squeeze bulbs, as commonly found on liquid extraction devices, in order to promote ventilation and drying of moisture within the squeeze bulb after use and/or washing.

2. Description of the Related Art

Liquid extraction devices, particularly basters, commonly use a rubber bulb which has an open end that removably attaches to an end of a rigid tube. The tube extends to an opposite, narrow open distal end. With the bulb squeezed or compressed, to reduce the volume of a hollow interior chamber of the bulb, the distal end of the tube is inserted into a liquid reservoir. Upon releasing the bulb, with the distal end of the tube below the surface, liquid in the reservoir is drawn into and maintained within the tube. To discharge the liquid from the distal end of the tube, the bulb is again squeezed to force air in the hollow interior chamber through the tube, causing the liquid to be expelled from the open distal end.

After use, the liquid extraction device is usually washed to clean the inside of the elongate tube and the squeeze bulb. For instance, after using a baster when cooking a roast or turkey, the baster needs to be washed in order to remove grease, oil, fat and the like from interior and exterior surfaces of the device. This is done by removing the squeeze bulb from the elongate tube and rinsing both items in a sink and/or dishwasher using a dishwashing detergent. Commonly, water remains within the rubber bulb after washing. If the bulb is placed upright, with the open end against a counter surface, the annular rim surrounding the open end of the squeeze bulb forms a seal against the counter surface, preventing ventilation of the interior chamber. On the other hand, if the squeeze bulb is left on its side, a puddle of water remains within the interior chamber due to the curvature of the wall structure of the squeeze bulb. In either case, mold and mildew will grow within the interior chamber, especially in warm, moist climates.

Accordingly, there remains a need in the field for a means to support a squeeze bulb of a liquid extraction device in an upright position so that liquid within the squeeze bulb will drip from the open end while air is able to freely enter the interior chamber of the squeeze bulb, thereby ventilating the interior chamber during the drying process and preventing growth of mold and mildew.

SUMMARY OF THE INVENTION

The present invention is directed to a squeeze bulb for use on a liquid extraction device. The squeeze bulb includes a collapsible wall structure formed of a flexible, resilient rubber. The wall structure is shaped and configured to include a main bulbous portion surrounding an interior chamber and an integral neck portion extending from the bulbous portion and terminating at an annular rim surrounding an open end of the bulb. A passage extends through the neck portion, from the open end to the interior chamber, in fluid communication therebetween. The passage is sized and configured for removable, snug-fitted receipt of a proximal end zone of an elongate, rigid tube of the liquid extraction device, in sealed relation therein. Squeezing the bulb to collapse the wall structure, thereby reducing the volume of the interior chamber, and then releasing the bulb to restore the volume of the interior chamber, creates a bi-directional fluid flow through the hollow tube sufficient to draw fluid through an open distal end of the tube and to subsequently dispense the fluid from the open distal end.

The present invention provides means for supporting the squeeze bulb in an upright position, with the open end facing downwardly and spaced above a support surface. The support means enables liquid to drain from within the bulb interior while allowing air flow to enter through the open end and into the interior chamber, thereby promoting drying of moisture within the squeeze bulb.

It is, therefore, a primary object of the present invention to provide an improved squeeze bulb for use on liquid extraction devices, wherein the squeeze bulb includes means to facilitate draining of liquid within the interior and to allow ventilation, to thereby promote drying of moisture within the squeeze bulb after washing.

It is a further object of the present invention to provide an improved squeeze bulb for use on liquid extraction devices, wherein the squeeze bulb includes support means about an annular rim; at the open end of the squeeze bulb; the support means being structured to hold the squeeze bulb in an upright position so that liquid can freely drain from the open end while air is permitted to enter the squeeze bulb interior.

It is still a further object of the present invention to provide a squeeze bulb, as set forth above, wherein the support means is integrally molded with the wall structure of the bulb and formed of the same material.

It is yet a further object of the present invention to provide an improved squeeze bulb, as set forth above, wherein the support means includes a plurality of feet members provided at spaced intervals about the annular rim of the squeeze bulb, at the open end, wherein the feet members are structured and disposed to support the squeeze bulb in an upright position so that the open end faces downwardly in spaced relation above a flat support surface.

It is still a further object of the present invention to provide an improved squeeze bulb, as set forth above, wherein the support means is structured and disposed to provide strength and rigidity to a neck portion of the squeeze bulb, so that the squeeze bulb can be supported in an upright position without collapsing.

These and other objects and advantages are more readily apparent with reference to the following detailed description and accompanying drawings.

BRIEF DESCRIPTION OF THE DRAWINGS

For a fuller understanding of the nature of the present invention, reference should be had to the following detailed description taken in connection with the accompanying drawings in which:

FIG. 1 is a perspective view of a first embodiment of the squeeze bulb of the present invention, shown on a liquid extraction device, wherein an elongate tube of the liquid extraction device is indicated by phantom lines;

FIG. 2 is a side elevation, in partial cutaway, showing the squeeze bulb of FIG. 1 supported in an upright position on a flat support surface;

FIG. 3 is a bottom plan view of the squeeze bulb of FIG. 1;

FIG. 4 is a perspective view of a second embodiment of the squeeze bulb, shown on a liquid extraction device, wherein an elongate tube of the liquid extraction device is indicated by phantom lines;

FIG. 5 is a side elevation of the squeeze bulb of FIG. 4 supported in an upright position on a flat support surface; and FIG. 6 is a bottom plan view of the squeeze bulb of FIG. 4.

Like reference numerals refer to like parts throughout the several views of the drawings.

DETAILED DESCRIPTION OF THE PREFERRED EMBODIMENTS

Referring to the several views of the drawings, the squeeze bulb of the present invention is shown and is generally indicated as 10. The squeeze bulb 10 is defined primarily by a collapsible wall structure 12 formed of a flexible, resilient material, such as rubber. The wall structure 12 may be approximately ⅛" to 3/16" thick, although the thickness may depart from this range depending upon the intended use and choice of materials. Further, the thickness may vary at different areas about the wall structure 12. The wall structure 12 is shaped and configured to include a main bulbous portion 14 surrounding an interior chamber 16 and an integral neck portion 18 extending from the bulbous portion 14 and terminating at an annular rim 20. The annular rim 20 surrounds an open end 22. A through passage 24 extends from the open end 22 to the interior chamber 16 in fluid communication therebetween. Upon squeezing an exterior surface 28 of the bulbous portion 14, applying inward pressure thereon, the wall structure 12 surrounding the interior chamber 16 is caused to collapse, thereby reducing the volume of the interior chamber 16. An abrupt, rapid collapse of the bulbous portion 14 results in air and liquid within the interior chamber being forced outwardly through the passage 24 and open end 22. Upon releasing the external squeezing force on the main bulbous portion 14, the resilient nature of the wall structure 12 causes the bulbous portion to return to its original, full shape, thereby increasing the volume of the interior chamber 16 when moving from the collapsed state to the relaxed, full shape. A rapid increase in the volume of the interior chamber 16 creates a suction force at the open end 22, resulting in air and/or liquid being drawn through the passage 24 and into the interior chamber 16 of the squeeze bulb 16.

In normal use, the squeeze bulb 10 is used on a liquid extraction device 100 in order to create a bi-directional fluid flow upon squeezing and releasing the bulbous portion 14. As seen in FIGS. 1 and 4, the various embodiments of the squeeze bulb 10 are shown attached to a proximal end zone 112 of an elongate rigid tube 110 of a liquid extraction device. To facilitate removable, fitted attachment of the squeeze bulb 10 to the proximal end zone 112 of the tube 110, the interior diameter of the open end 22 and passage 24 through the neck portion 18 is specifically sized for snug engagement about an outer surface of the tube 110 at the proximal end zone 112. It is further desirous and necessary that the engagement of the inner surface 32 of the neck portion, surrounding the through passage, engage the outer surface of the tube 110 to create an air-tight and liquid-tight seal. Accordingly, upon rapidly collapsing the bulbous portion 14, air is forced through the length of the hollow tube 110 and out from a tapered open distal end 114. Upon releasing the external squeezing force, causing the bulb to expand to its original, relaxed state, a suction is created at the open distal end 114 of the liquid extraction device 100. In this manner, liquid can be drawn through the distal end and into the tube for subsequent dispensing therefrom.

The improvement of the present invention is primarily directed to support means 40 for maintaining the squeeze bulb in an upright position on a flat surface FS, when separated from the elongate tube 110, so that the open end 22 faces downwardly with the annular rim 20 maintained in spaced relation above the flat surface FS to define ventilation gaps 42 between the annular rim 20 and the support surface FS, as seen in FIGS. 2 and 5. The spacing of the annular rim above the support surface to create the ventilation gaps 42, permits air to flow through the open end 22 and into the interior chamber 16, thereby promoting drying of moisture within the passage and the interior chamber 16. Further, in the upright position, as seen in FIGS. 2 and 5, liquid that is in the interior chamber 16 after washing is caused to drain, by force of gravity, out through the open end 22 and onto the support surface FS.

Referring to FIGS. 1–3, a first preferred embodiment of the present invention is shown, wherein the support means 40 includes a plurality of feet members 50 provided at spaced intervals about the annular rim 20. The feet members 50 are integrally formed with the wall structure 12, from the same material. The feet members 50 protrude outwardly from the annular rim 20 and include terminal ends 52 structured and disposed for supporting engagement on the flat surface FS to maintain the annular rim 20 in spaced relation above the support surface, as seen in FIG. 2. The feet members 50 further serve to create the ventilation gaps 42 about the annular rim 20, between each of the feet members 50.

Referring to FIGS. 4–6, a second preferred embodiment of the present invention is shown, wherein the support means 40' includes a plurality of rib members 60 disposed in spaced relation about the exterior wall surface of the neck portion 18, and extending in generally parallel relation to one another beyond the annular rim 20. The rib members 60 are preferably integral with the wall structure 12 and formed of the same material. Each of the rib members 60 extends beyond the annular rim 20 to a terminal end 62 structured and disposed for supporting engagement with the flat support surface to maintain the annular rim in spaced relation above the flat surface, as seen in FIG. 5. Similar to the embodiment of FIG. 2, the ventilation gaps 42 are formed below the annular rim 20, between the rib members 60.

The combined thickness of each of the rib members 60 and the wall structure 12 of the neck portion 18 is approximately twice that of the other areas of the wall structure 12, thereby providing increased strength and rigidity to the neck portion 18. In this manner, the squeeze bulb 10 is able to stand in the upright position, as seen in FIG. 5, without the neck portion 18 collapsing under the weight of the bulbous portion 14.

While the instant invention has been shown and described in what is considered to be preferred and practical embodiments thereof, it is recognized that departures may be made within the spirit and scope of the present invention which, therefore, should not be limited except as defined within the following claims and as interpreted under the doctrine of equivalents.

Now that the invention has been described,

What is claimed is:

1. In a liquid extraction device, a squeeze bulb removably attachable to a proximal end zone of an elongate hollow tube of the device for creating a forced, bi-directional fluid flow through the hollow tube in order to draw fluid through an open distal end of the tube and to subsequently dispense the fluid from the open distal end, said squeeze bulb comprising:

a collapsible wall structure formed of a flexible, resilient material and being shaped and configured to include a main bulbous portion surrounding an interior chamber and an integral neck portion extending from said bulbous portion and terminating at an annular rim to define an open end, said neck portion surrounding a passage extending from said open end to said interior chamber, in fluid communication therebetween, and said open end and said passage being sized and configured for removable, snug-fitted receipt of the proximal end zone of the elongate tube in sealed relation therein, and means for supporting said squeeze bulb in an upright position on a flat surface when separated from the elongate tube, so that said open end faces downwardly with said annular rim maintained in spaced relation to the flat surface to define at least one ventilation gap therebetween, permitting air flow through said passage and to said interior chamber, thereby promoting drying of moisture within said passage and said interior chamber.

2. A squeeze bulb as recited in claim 1 wherein said means for supporting said squeeze bulb in an upright position includes a plurality of feet members provided at spaced intervals about said annular rim and protruding therefrom, away from said open end, said feet members each including a terminal end structured and disposed for supporting engagement on the flat surface to maintain said annular rim in spaced relation above the flat surface, and said feet members defining a plurality of said ventilation gaps about said annular rim.

3. A squeeze bulb as recited in claim 1 wherein said means for supporting said squeeze bulb in an upright position includes a plurality of rib members formed along a portion of an exterior wall surface of the neck portion, each of said rib members extending beyond said annular rim to a terminal end structured and disposed for supporting engagement with the flat surface to maintain said annular rim in spaced relation above the flat surface and defining a plurality of said ventilation gaps about said annular rim.

4. A squeeze bulb as recited in claim 3 wherein said rib members are structured and disposed to provide rigidity to said neck portion to prevent collapsing of said wall structure at said neck portion when supported in the upright position.

5. A squeeze bulb for creating a forced fluid flow through a liquid extraction and expelling device comprising:

a collapsible wall structure formed of a flexible, resilient material and being shaped and configured to include a main bulbous portion surrounding an interior chamber and an integral neck portion extending from said bulbous portion and terminating at an annular rim to define an open end, said neck portion surrounding a passage extending from said open end to said interior chamber, in fluid communication therebetween, and means for supporting said squeeze bulb in an upright position on a flat surface so that said open end faces downwardly with said annular rim maintained in spaced relation to the flat surface to define at least one ventilation gap therebetween, permitting air flow through said passage and into said interior chamber, thereby promoting drying of moisture within said passage and said interior chamber.

6. A squeeze bulb as recited in claim 5 wherein said means for supporting said squeeze bulb in an upright position includes a plurality of feet members provided at spaced intervals about said annular rim and protruding therefrom, away from said open end, said feet members each including a terminal end structured and disposed for supporting engagement on the flat surface to maintain said annular rim in spaced relation above the flat surface, and said feet members defining a plurality of said ventilation gaps about said annular rim.

7. A squeeze bulb as recited in claim 5 wherein said means for supporting said squeeze bulb in an upright position includes a plurality of rib members formed along a portion of an exterior wall surface of the neck portion, each of said rib members extending beyond said annular rim to a terminal end structured and disposed for supporting engagement with the flat surface to maintain said annular rim in spaced relation above the flat surface and defining a plurality of said ventilation gaps about said annular rim.

8. A squeeze bulb as recited in claim 7 wherein said rib members are structured and disposed to provide rigidity to said neck portion to prevent collapsing of said wall structure at said neck portion when supported in the upright position.

* * * * *